United States Patent [19]

Cheng

[11] Patent Number: 5,070,539

[45] Date of Patent: Dec. 3, 1991

[54] WASHABLE MUG WITH SELF-CONTAINED SOUND SYSTEM

[76] Inventor: Peter S. C. Cheng, 5 Ross Street, Toronto, Ontario, Canada, M5T 1Z8

[21] Appl. No.: 380,587

[22] Filed: Jul. 17, 1989

[51] Int. Cl.[5] ..... H04B 1/06; B65D 25/28

[52] U.S. Cl. ..... 455/344; 455/350; 220/94 A

[58] Field of Search ..... 381/169, 122, 75; D14/165, 163; D21/112; 379/434; 455/344, 312, 348, 349, 350, 351, 74, 90; 215/100 A; 220/625, 94 A

[56] References Cited

U.S. PATENT DOCUMENTS

| | | | |
|---|---|---|---|
| 3,258,534 | 6/1966 | Goldsworthy . | |
| 3,412,207 | 11/1968 | Sugawara | 381/75 |
| 3,624,788 | 11/1971 | McMahon | 215/100 A |
| 3,890,475 | 6/1975 | Denhart . | |
| 4,791,030 | 12/1988 | DeMars | 428/542.4 |
| 4,792,994 | 12/1988 | Aylward | 455/344 |
| 4,867,187 | 9/1989 | Divine | 455/344 |
| 4,936,037 | 6/1990 | Holcomb | 455/66 |

*Primary Examiner*—Curtis Kuntz
*Assistant Examiner*—Christine K. Belzer
*Attorney, Agent, or Firm*—Kirschstein, Ottinger, Israel & Schiffmiller

[57] ABSTRACT

A mug having a self-contained voice-amplification system or a radio incorporated therein is capable of being washed without damaging the system or radio as a result of such washing. The system or radio is supported by a discrete handle which is separately attachable to and detachable from a cup of a bi-partite mug.

13 Claims, 2 Drawing Sheets

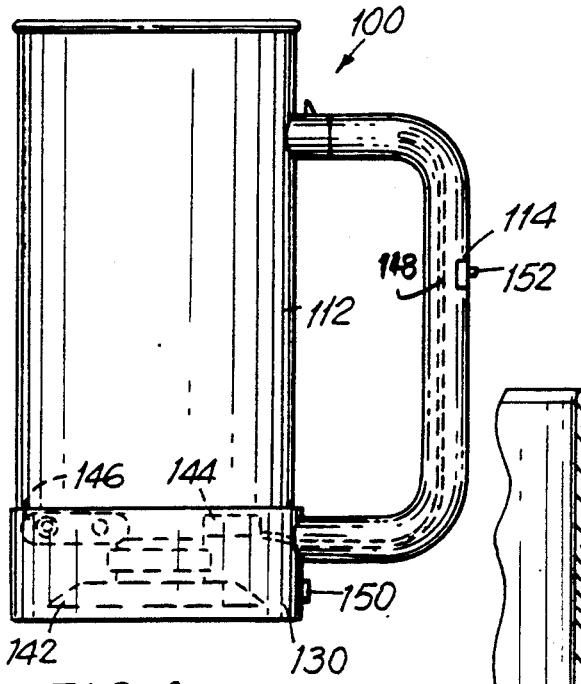
FIG. 4
FIG. 3
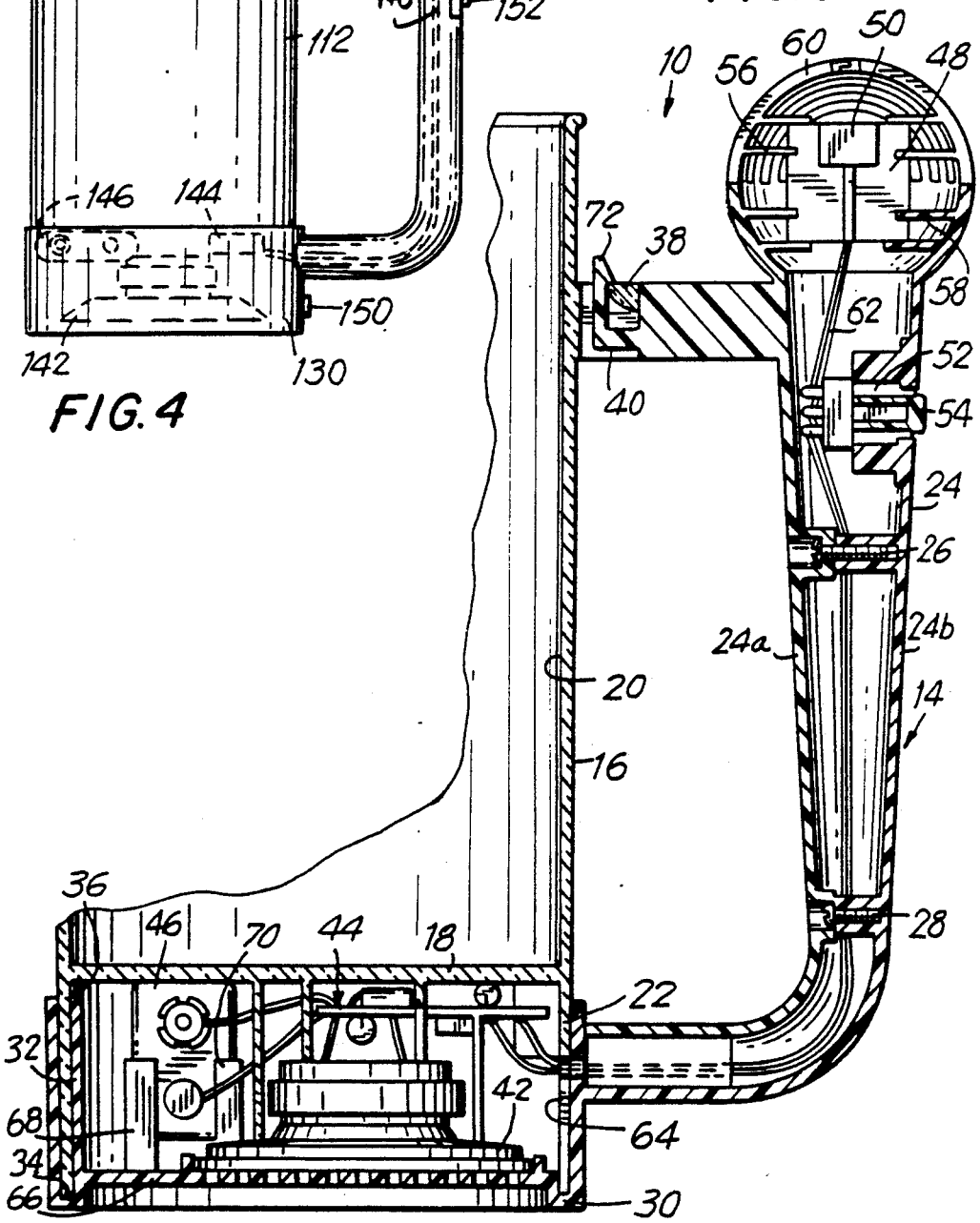

WASHABLE MUG WITH SELF-CONTAINED SOUND SYSTEM

BACKGROUND OF THE INVENTION

1. Field of the Invention

This invention generally relates to a mug having a self-contained electrical system operative for emitting sounds such as a drinker's amplified voice or broadcast radio signals and, more particularly, to a mug capable of holding a beverage during use and of being conveniently washed without damaging the electrical system during such washing.

2. Description of Related Art

At many social gatherings and celebrations, beverages are often drunk from mugs having handles. Typically, many such social occasions are noisy affairs, and it sometimes proves difficult for individuals to be heard over the noise of the crowd. Thus, offering a toast or singing a song or just speaking to a neighbor can be a trial. Even when background noise is not a problem, one still may want his or her voice to be amplified so that it can be readily heard without having to shout and strain one's vocal cords, or merely for the sheer fun of it. Megaphones have typically been used to amplify and project one's voice, but megaphones are not readily available, and certainly not in one's home or at social celebrations.

SUMMARY OF THE INVENTION

1. Objects of the Invention

It is a general object of this invention to provide a novel, dual-purpose mug from which one can drink and, at the option of the drinker, to have his or her voice amplified.

It is another object of this invention to amplify a drinker's voice by readily available sound system.

Another object of this invention is to enable a drinker to offer spontaneous toasts, songs, speeches and the like which will be readily heard, even above crowd noise.

Still another object of this invention is to provide a self-contained voice amplification electrical system within the mug which will not be damaged or exposed to water when the mug is washed and cleaned.

Yet another object of this invention is to provide a radio within the mug for broadcasting radio signals to entertain all those in the vicinity of the mug without damaging the radio when the mug is washed and cleaned.

A still further object of this invention is to provide a novel recreational mug which is durable and inexpensive to construct.

2. Features of the Invention

In keeping with these objects, and others which will become apparent hereinafter, one feature of this invention resides, briefly stated, in a washable, sound-emitting mug which comprises a cup for containing a beverage, and a discrete handle. An electrical system is supported by the handle, and is operative for converting electrical energy into acoustical energy. The system includes a speaker on the handle, and operative for emitting sounds therefrom. A detachable connector connects the handle to the cup for holding the cup and the beverage therein during use. The detachable connector also serves to detach the handle and the electrical system supported thereon from the cup. This latter feature enables the cup to be separately washed and cleaned apart from the electrical system in order to avoid damaging the latter during such washing and cleaning.

According to one preferred embodiment, the electrical system includes a battery powered microphone for detecting sounds, e.g. a drinker's voice, uttered in the vicinity of the handle. The microphone generates electrical signals indicative of the detected sounds. Preferably, the microphone is mounted at an upper portion of the handle in the vicinity of the drinker's mouth.

The operation of the microphone may be conveniently controlled by a control switch provided on the handle. The control switch is preferably manually actuatable and may constitute an on/off or volume control switch.

The electrical system further comprises an amplifier in another portion of the handle. The amplifier is electrically connected between the microphone and the speaker. The amplifier serves to amplify the electrical signals generated by the microphone in order to drive the speaker.

According to another embodiment of this invention, the electrical system constitutes a battery powered radio for receiving radio frequency electrical signals to drive the speaker. A radio antenna is mounted on the handle.

In either embodiment, the cup is advantageously formed to have a cylindrical side wall and a bottom wall which together bound a space in which the beverage is contained. The cup has an annular skirt extending away from the bottom wall. For its part, the handle has a generally upright handle portion and a base portion. The base portion has channel walls bounding an annular channel in which the skirt is received, as well as a stop wall for abuttingly engaging the bottom wall when the skirt is fully received in the channel. The detachable connector includes a first coupler provided on the side wall of the cup, and a second coupler provided on the upright handle portion. These two couplers matingly engage each other during use, and preferably with a snap-type action.

During use of the mug according to this invention, the handle is connected to the cup due to the mating interengagement of the couplers. A beverage such as beer, milk, water, juice, wine, etc. may be poured into the cup and contained therein, and readily drunk with the aid of the attached handle. If desired, the drinker can manually actuate the control switch and energize the electrical system. In the case of the first embodiment described above, one may thereupon speak or sing into the microphone and have his or her voice amplified and projected. In the case of the second embodiment, the radio will be activated, and the drinker can listen to the radio. In still another variant of this invention, both of the aforementioned embodiments can be combined in a single mug, thereby giving the user the option of either listening to the radio or having a public address system amplify his or her voice.

After the beverage has been drunk, or at least before it can be used by another, it is desired to use water to wash the mug. However, such water would inevitably damage the electrical system. Rather than using expensive potting compounds or moisture-resistant seals to prevent water from entering the electrical system, this invention proposes detaching the handle from the cup. It will be remembered that the electrical system is supported entirely on the handle. Hence, the cup, which initially contained the beverage, can be separately washed and cleaned apart from the handle and the electrical system thereon without damaging the electrical system because, simply put, the cleaning water never contacts the electrical system. This novel two-part mug construction is thus readily washable and, at the same time, enables a drinker to offer spontaneous toasts, speeches and the like, thus greatly increasing the recreational aspects of the mug.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a broken-away sectional view taken on line 3—3 of FIG. 2; and

FIG. 4 is a front view of a mug according to another embodiment of this invention.

DETAILED DESCRIPTION OF THE PREFERRED EMBODIMENTS

Figure 1:
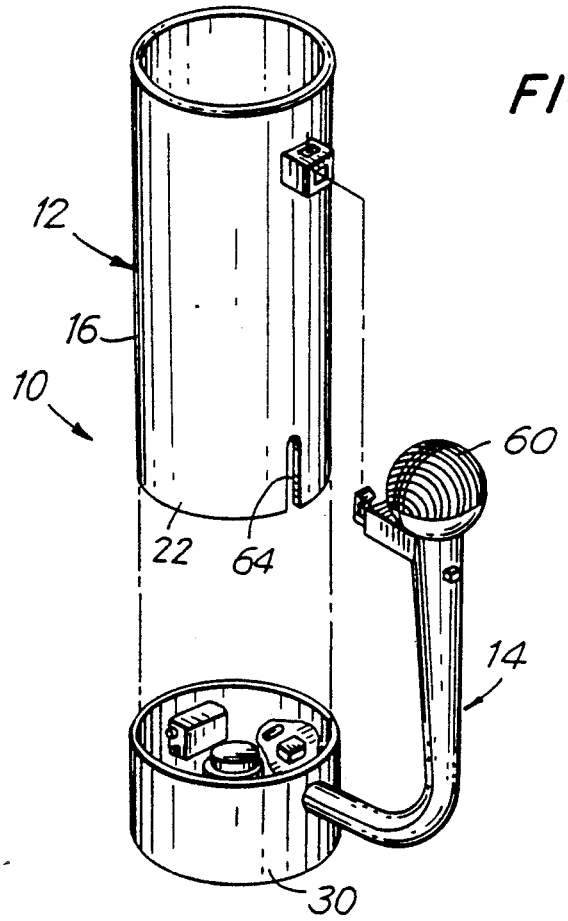
FIG. 1 is a front perspective exploded view of a mug according to one embodiment of this invention.
Figure 2:
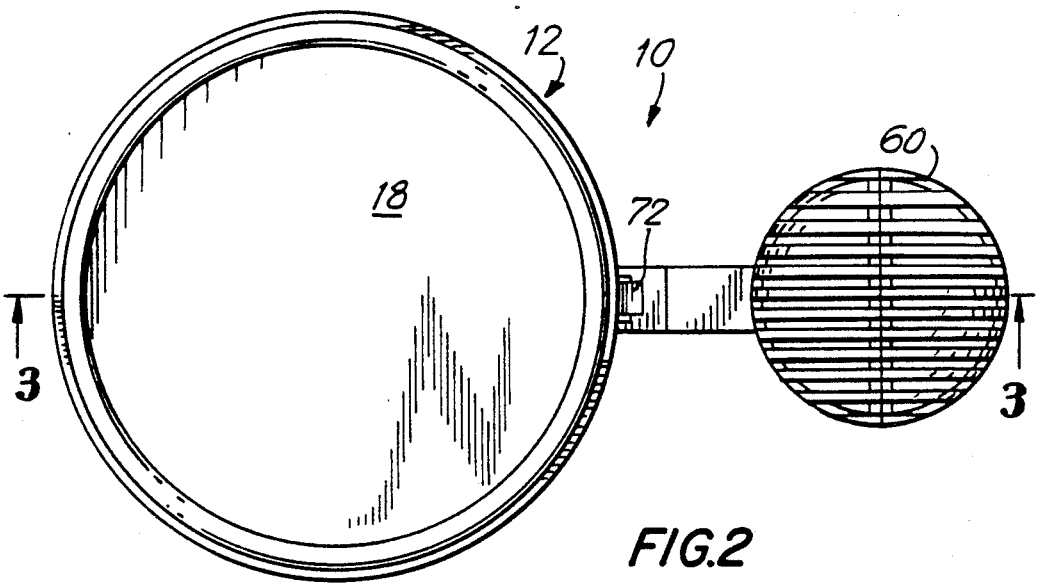
FIG. 2 is an enlarged top plan view of the embodiment of FIG. 1 with the handle attached to the cup.

Referring now to the drawings, reference numeral 10 generally identifies a washable sound-emitting mug according to a first embodiment illustrated in FIGS. 1–3. The mug 10 comprises a cup 12 and discrete handle 14. The cup 12 has a cylindrical side wall 16 and a bottom wall 18 (see FIG. 3). The side wall 16 and the bottom wall 18 together bound a space 20 in which a beverage such as beer, milk, juice, water, wine, etc. is contained. The cup also has an annular cylindrical skirt 22 extending away from the bottom wall 18 and being, in effect, a continuation of the cylindrical side wall 16.

As best shown in FIG. 3, the handle 14 has a generally upright hollow handle portion 24 composed of two half-shell sections *24a*, *24b* interconnected by fasteners 26, 28.

The handle also has a cylindrical base portion 30 having internal channel walls 32 bounding an annular channel 34 in which the skirt 22 is received. A stop 36 at the uppermost portion of the channel walls 32 abuttingly engages the underside of the bottom wall 18 when the skirt is fully received in the channel 34.

As described in greater detail below, a first coupler 38 is integral with, and extends outwardly from, the side wall 16 of the cup, and a complementary second coupler 40 is integral with, and extends outwardly of, the upright handle portion 24. The couplers 38, 40 matingly interengage each other, preferably with a snap-type action, when the mug is used for drinking purposes.

According to a first embodiment of this invention, an electrical system is entirely supported by the handle 14. This electrical system converts electrical energy into acoustical energy. The system includes a speaker 42 operative for emitting sounds when driven by electrical signals generated by an amplifier circuit 44. A battery 46 is electrically connected to the amplifier circuit 44 to power the same. A microphone 50, preferably surrounded by a shock-absorbing sponge 48, is electrically connected via a control switch 52 having a manually operated armature 54 to the amplifier circuit 44. As best shown in FIG. 3, the microphone 50 and shock absorber 48 are mounted at the uppermost section of the upright handle portion 24, and are held in place by opposing sets of fingers 56, 58 which project inwardly into the interior space of the handle at a generally spherical, slotted section 60. The electrical wiring 62 which interconnects the microphone 50 to the switch 52 and thereupon to the amplifier circuit 44 is routed through the interior of the hollow handle 14. A key slot 64 is formed on the skirt 22 to permit passage therethrough of the wiring 62.

The base portion 30 is provided with an apertured support wall or grille 66 on which the speaker 42 is pressed in tight engagement. A set of support posts 68, 70 extend upwardly from the grille 66 in order to securely hold the battery 46 in place within the base portion 30. The amplifier circuitry 44 is also housed within the base portion 30. The bottom wall 18 of the cup overlies those components of the electrical system mounted within the base portion 30.

In order to attach the handle to the cup, the coupler 40 must first be inserted into a clearance hole formed in the first coupler 38. The coupler 40, as well as the handle 14 and the cup 12, are all constituted of a resilient synthetic plastic material. Hence, the coupler 40, which is advantageously formed as a hook, is slightly deformed during insertion into said hole of the first coupler. As shown in FIG. 3, when the hook-type coupler 40 is fully inserted into the first coupler 38, a wedge-shaped head portion 72 snappingly engages the coupler 38. At the same time, the skirt 22 is fully inserted into the channel 34, thereby completing the attachment of the handle to the cup.

When drinking a beverage from the cup, a drinker may actuate the switch armature 54 to control the operation of the microphone 50. Thus, the drinker may speak or sing into the slotted spherical section 60 through which the sounds are detected by the microphone 50 and converted into electrical signals that are conveyed along electrical wiring 62 to the amplifier circuitry 44 for driving the speaker 42. The sounds produced by the speaker 42 emanate from the apertured grille 66. Hence, in order not to muffle the sound, it is desirable that the mug be raised off a countertop, i.e. to be positioned in the immediate vicinity of the drinker's head, when projecting sound.

When it is desired to clean the mug, it is merely necessary to push the head 72 of the second coupler 40 out of snapping engagement with the first coupler 38 and to simultaneously lift the cup 12 from the base portion 30 of the handle. When the handle is disconnected from the cup, the cup may be washed by immersion in water or other cleaning solution. The electrical system, which is entirely supported on the handle, therefore, does not come in contact with the cleaning solution.

According to another embodiment of this invention, as best shown in FIG. 4, a mug 100, again of two-part construction, includes a handle 114 and a cup 112. This time, rather than a self-contained voice-amplification public address system being supported on the handle, a radio is mounted within a base portion 130 of the handle. The radio includes a speaker 142, a battery 146, and an amplifier-tuner circuit 144. A radio antenna 148 is routed through the hollow interior of the handle 114 and, if the dimensions of the handle are not sufficient for that purpose, the antenna may also be routed about the interior periphery of the base portion 130. A control switch 152 is mounted on the handle portion in order to turn the radio on or off, and can also be used to control the volume of the broadcast sounds. Tuning can advantageously be achieved by turning a rotatable dial 150 which extends outwardly through a clearance slot in the base portion 130.

As before, the handle 114 is attachable to and detachable from the cup 112 by snap-action type couplers at an upper portion of the handle 114. The cup 112 is inserted into an annular channel provided within the base portion 130 as described earlier.

It will be understood that each of the elements described above, or two or more together, also may find a useful application in other types of constructions differing from the types described above.

While the invention has been illustrated and described as embodied in a washable mug with self-contained sound system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A washable, sound-emitting mug, comprising:

(a) a cup for containing a beverage, said cup having an annular side wall bounding a mouth;

(b) a discrete handle having a generally upright handle portion alongside the side wall;

(c) an electrical system supported by the handle, and operative for converting electrical energy into acoustical energy, including a battery-powered microphone mounted on the upright handle portion adjacent the cup mouth, said microphone being operative for detecting sounds uttered in the vicinity of the cup mouth and for generating electrical signals indicative of the detected sounds, said system further including a speaker mounted on the handle and electrically connected to the microphone, said speaker being operative for emitting the detected sounds therefrom; and (d) detachable connector means for connecting the handle to the cup for holding the cup and the beverage therein during use, and for detaching the handle and the electrical system supported thereon from the cup to separately wash and clean the cup away from the electrical system to avoid damaging the electrical system during such washing and cleaning.

2. The mug as recited in claim 1, wherein the microphone is mounted atop the upright handle portion away from the side wall of the cup.

3. The mug as recited in claim 1, wherein the a base portion in which the speaker is mounted.

4. The mug as recited in claim 3, wherein the system includes an amplifier in the base portion, and operatively electrically connected between the microphone and the speaker, said amplifier being operative for amplifying the electrical signals to drive the speaker.

5. The mug as recited in claim 3, wherein the system includes a control switch on the handle portion, for controlling the microphone.

6. The mug as recited in claim 5, wherein the control switch is a manually actuatable on/off switch.

7. The mug as recited in claim 5, wherein the control switch is a manually actuatable volume control switch.

8. The mug as recited in claim 1, wherein the cup has a bottom wall bounding with the side wall a space in which the beverage is contained, and wherein the cup has an annular skirt extending away from the bottom wall; and wherein the handle has a base portion, and wherein the base portion has channel walls bounding an annular channel in which the skirt is received, and a stop for abuttingly engaging the bottom wall when the skirt is fully received in the channel.

9. The mug as recited in claim 1, wherein the connector means includes a first coupler on the cup, and a second coupler on the handle, said couplers matingly coupling with each other during use.

10. The mug as recited in claim 9, wherein the couplers engage each other with a snap-type action during use.

11. The mug as recited in claim 1, wherein the electrical system includes a battery-powered radio for receiving radio frequency electrical signals to drive the speaker.

12. The mug as recited in claim 11, wherein the radio includes an antenna mounted on the handle.

13. The mug as recited in claim 2, wherein the upright handle portion has an uppermost slotted spherical section in which the microphone is mounted.

* * * * *